US009133007B2

(12) United States Patent
Clüsserath

(10) Patent No.: US 9,133,007 B2
(45) Date of Patent: Sep. 15, 2015

(54) BEVERAGE BOTTLING PLANT FOR FILLING BOTTLES WITH A LIQUID BEVERAGE MATERIAL AND AN ASEPTIC BOTTLING SYSTEM FOR THE ASEPTIC BOTTLING OF A LIQUID MATERIAL

(75) Inventor: Ludwig Clüsserath, Bad Kreuznach (DE)

(73) Assignee: KHS GmbH, Dortmund (DE)

( * ) Notice: Subject to any disclaimer, the term of this patent is extended or adjusted under 35 U.S.C. 154(b) by 2192 days.

(21) Appl. No.: 11/050,484

(22) Filed: Feb. 3, 2005

(65) Prior Publication Data

US 2005/0188651 A1 Sep. 1, 2005

(30) Foreign Application Priority Data

Feb. 4, 2004 (DE) ..... 10 2004 005 342

(51) Int. Cl.
*B65B 5/00* (2006.01)
*B67C 7/00* (2006.01)
*B65D 45/00* (2006.01)

(52) U.S. Cl.
CPC ..... *B67C 7/002* (2013.01); *B67C 7/0073* (2013.01)

(58) Field of Classification Search
CPC ..... B65B 43/60; B65B 43/50; B65B 55/027; B65B 1/04; B67C 7/002; B67C 7/004; B67C 7/0046; B67C 7/0053; B67C 7/0073
USPC ..... 53/253, 331.5, 317, 319, 415, 425, 476, 53/485, 281, 282, 272, 276
See application file for complete search history.

(56) References Cited

U.S. PATENT DOCUMENTS

| | | | | | |
|---|---|---|---|---|---|
| 3,115,819 | A | * | 12/1963 | Mahlmeister et al. | 454/187 |
| 4,409,889 | A | * | 10/1983 | Burleson | 454/187 |
| 4,587,793 | A | * | 5/1986 | Brennan et al. | 53/425 |
| 4,626,262 | A | * | 12/1986 | Forss | 96/60 |
| 5,511,594 | A | * | 4/1996 | Brennan et al. | 141/98 |
| 5,713,403 | A | * | 2/1998 | Clusserath et al. | 141/101 |
| 5,720,148 | A | | 2/1998 | Bedin et al. | |
| 5,848,515 | A | | 12/1998 | Catelli et al. | |
| 6,026,867 | A | | 2/2000 | Klarl et al. | |
| 6,119,433 | A | * | 9/2000 | Kitahora et al. | 53/167 |
| 6,134,866 | A | * | 10/2000 | Schoenewolff et al. | 53/561 |

(Continued)

FOREIGN PATENT DOCUMENTS

| | | |
|---|---|---|
| DE | 195 20 925 A1 | 12/1996 |
| DE | 197 31 796 A1 | 1/1999 |

(Continued)

OTHER PUBLICATIONS

European Patent Office Search Report EP 05 00 0781 and English translation thereof.

*Primary Examiner* — Stephen F Gerrity
*Assistant Examiner* — Joy N Sanders
(74) *Attorney, Agent, or Firm* — Nils H. Ljungman & Associates

(57) ABSTRACT

Container filling plant for aseptically filling containers, which plant has a filling machine and a closing machine inside a clean room. The plant further has shields which surround the filling machine and/or the closing machine to minimize the passage of contaminants produced by the operation or repair of the machines into an area of the clean room outside of the shields. Air is passed through the interior of the shields to conduct contaminants through an outlet and out of the clean room.

20 Claims, 10 Drawing Sheets

(56) References Cited

U.S. PATENT DOCUMENTS

| | | | | |
|---|---|---|---|---|
| 6,185,910 | B1 * | 2/2001 | Achhammer | 53/426 |
| 6,276,113 | B1 * | 8/2001 | Bernhard | 53/253 |
| 6,684,607 | B2 * | 2/2004 | Ng et al. | 53/426 |

FOREIGN PATENT DOCUMENTS

| | | | |
|---|---|---|---|
| DE | 102 13 343 | A1 | 10/2003 |
| DE | 202004001619 | U1 | 5/2004 |
| DE | 202004001819 | U1 | 5/2004 |
| EP | 0 250 596 | | 1/1988 |
| EP | 405402 | A2 * | 1/1991 |
| JP | S 62125238 | A | 6/1987 |
| JP | H 10157797 | A | 6/1998 |
| JP | 2001 056140 | A | 2/2001 |
| JP | 2003 513861 | A | 4/2003 |
| JP | 2004 001840 | A | 1/2004 |
| WO | WO 01/34477 | A1 | 5/2001 |

* cited by examiner

BEVERAGE BOTTLING PLANT FOR FILLING BOTTLES WITH A LIQUID BEVERAGE MATERIAL AND AN ASEPTIC BOTTLING SYSTEM FOR THE ASEPTIC BOTTLING OF A LIQUID MATERIAL

BACKGROUND

1. Technical Field

The present application relates to a beverage bottling plant for filling bottles with a liquid beverage material and an aseptic bottling system for the aseptic bottling of a liquid material in bottles or similar containers. The present application further relates to the bottling of hygienically and microbiologically sensitive products under sterile air conditions, such as wine, beer or carbonated fruit flavored beverages, for example.

2. Background Information

A beverage bottling plant for filling bottles with a liquid beverage filling material can possibly comprise a beverage filling machine with a plurality of beverage filling positions, each beverage filling position having a beverage filling device for filling bottles with liquid beverage filling material. The filling devices may have an apparatus designed to introduce a predetermined volume of liquid beverage filling material into the interior of bottles to a substantially predetermined level of liquid beverage filling material. The apparatus designed to introduce a predetermined flow of liquid beverage filling material further comprises an apparatus that is designed to terminate the filling of the beverage bottles upon the liquid beverage filling material reaching the predetermined level in bottles. There may also be provided a conveyer arrangement that is designed to move bottles, for example, from an inspecting machine to the filling machine. Upon filling, a closing station closes the filled bottles. There may further be provided a conveyer arrangement configured to transfer filled bottles from the filling machine to the closing station. Bottles may be labeled in a labeling station, the labeling station having a conveyer arrangement to receive bottles and to output bottles. The closing station and the labeling station may be connected by a corresponding conveyer arrangement.

The present application relates to a plant for the aseptic bottling of a liquid in bottles or similar containers. It is frequently necessary to bottle a liquid aseptically, i.e. under clean room conditions (e.g. Clean Room Class 100) in bottles or similar containers, and then to close said bottles or containers under clean room conditions, for example for the bottling of highly perishable beverages such as milk products, juices, or pharmaceutical products etc. The present application further relates to the bottling of hygienically and microbiologically sensitive products under sterile air conditions, such as wine, beer or carbonated fruit flavored beverages, for example.

The prior art describes plants for aseptic bottling that form a clean room or clean room area inside an enclosure which is closed off from the outside and is supplied with filtered, sterile air, and through which a conveyor line for the containers or bottles runs. In a plant of this type, inside the clean room area, a rinser, a filling machine and a capper are provided one after another in the direction of transport. As a rule, this clean room area is surrounded by a security area in which there are, among other things, air locks or pass-throughs for the feed of the empty containers to be filled and for the removal of the filled and capped containers.

Container handling machines include, for example, filling machines, capping machines, rinsers etc. In higher-capacity bottling plants, these machines employ a rotating construction, whereby the handling spaces that hold the containers are located on the periphery of a carousel and carry along the containers in a circulating movement during handling operations.

OBJECT OR OBJECTS

An object is to create a plant for aseptic bottling that makes it possible to keep the volume of the space that has to be supplied with the sterile air as small as possible, thereby reducing, among other things, the construction and operating costs. The present application teaches that this object can be accomplished by a plant as described herein below.

SUMMARY

In the plant described in the present application, in the extreme case the clean room or clean room area for which the clean room conditions required for aseptic production (e.g. Clean Room Class 100) must be maintained, the clean room is determined only by the three-dimensional space defined by the space occupied by the filling machine, the capper and optionally by a treatment machine that may be upstream of the filling machine, e.g. for the cleaning and/or sterilization of the containers (e.g. a rinser). In particular the filling machine, but also preferably a handling machine upstream of said filling machine extend with their hollow cylindrical housing that surrounds the rotor of the machine to the upper boundary or cover of the clean room area, where it or they are connected directly to the air outlet located there, or the hollow cylindrical housing can even form said air outlet opening, to eliminate dead spaces above the machine and thereby keep the overall volume of the clean room area small. In an additional altogether advantageous realization, the hollow-cylindrical shields extend through the upper limit or ceiling of the clean room area.

In one possible embodiment, the shielding of the filling machine and/or of the additional handling machine with its interior acts as a return air duct, i.e. the air duct is realized so that the filtered sterile clean air is fed to the clean room area by means of at least one filtering device, which can be in the ceiling area, for example, enters the interior of the respective shield in the vicinity of the clean room floor, and flows upward inside said shield to the air outlet opening. This configuration also has the advantage that interventions such as repairs and maintenance operations on the filling machine and/or on the additional handling machines inside the respective shield can be performed from above, without having to disrupt the clean room conditions in the sterile area outside the shields.

The above-discussed embodiments of the present invention will be described further hereinbelow. When the word "invention" or "embodiment of the invention" is used in this specification, the word "invention" or "embodiment of the invention" includes "inventions" or "embodiments of the invention", that is the plural of "invention" or "embodiment of the invention". By stating "invention" or "embodiment of the invention", the Applicant does not in any way admit that the present application does not include more than one patentably and non-obviously distinct invention, and maintains that this application may include more than one patentably and non-obviously distinct invention. The Applicant hereby asserts that the disclosure of this application may include more than one invention, and, in the event that there is more than one invention, that these inventions may be patentable and non-obvious one with respect to the other.

BRIEF DESCRIPTION OF THE DRAWINGS

Developments of the embodiments are explained herein below. The embodiments are explained in greater detail below with reference to the exemplary embodiments illustrated in the accompanying figures, in which.

DESCRIPTION OF EMBODIMENT OR EMBODIMENTS

Figure 1:
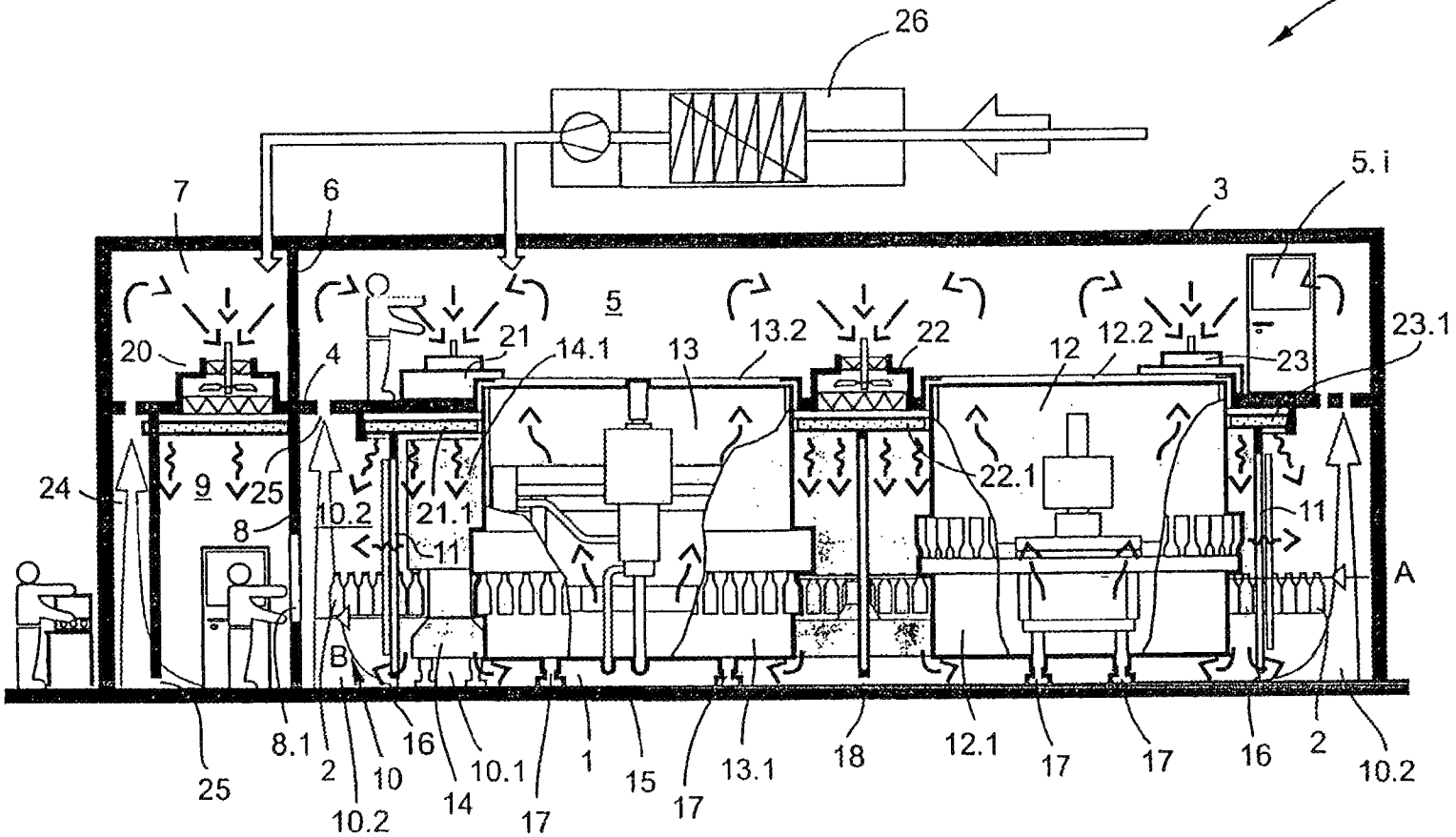
FIG. 1 is a simplified view in elevation of a plant as claimed by the present application for the aseptic bottling of a liquid in bottles or similar containers.
Figure 1A:
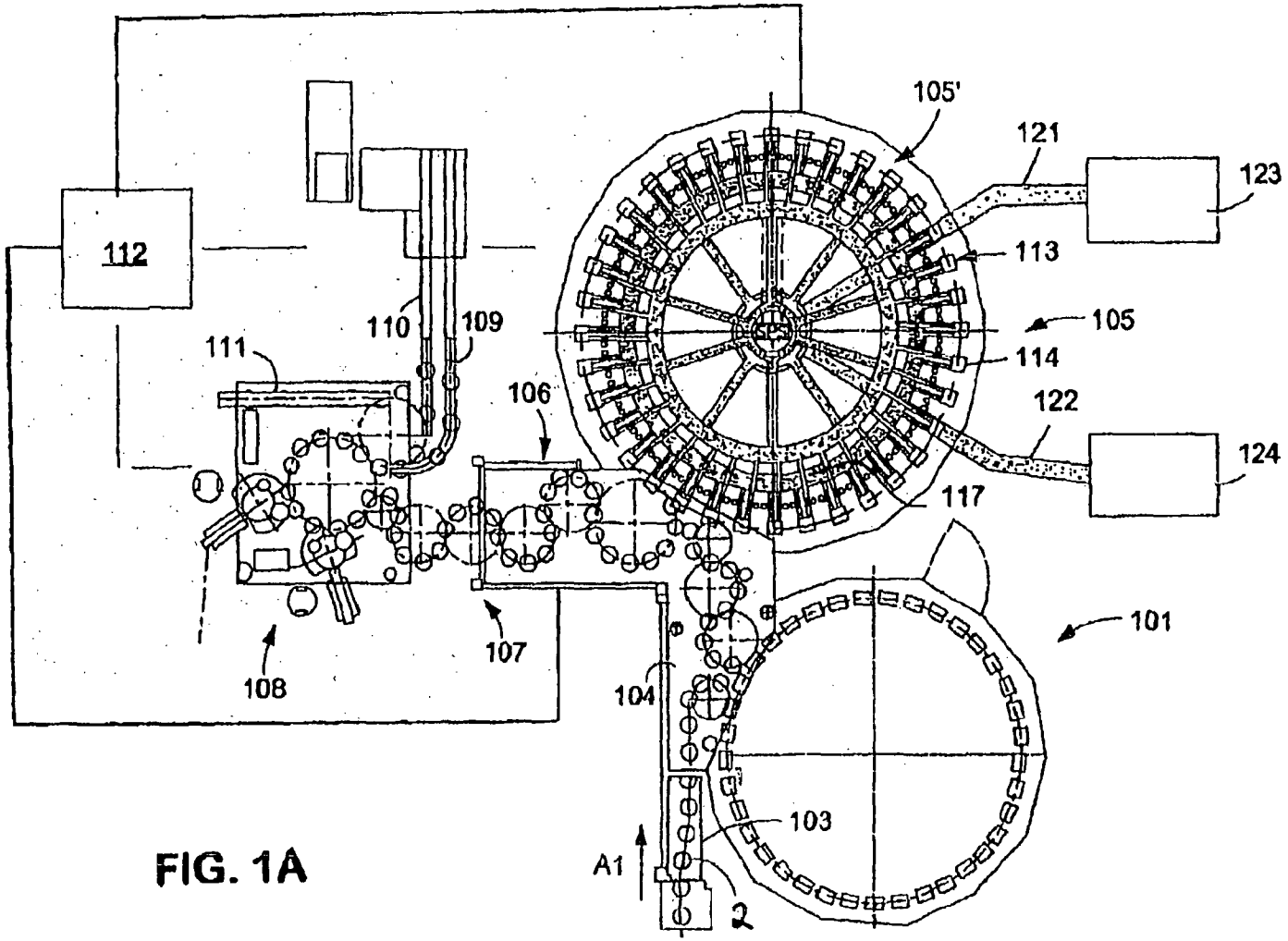
FIG. 1A is a schematic illustration of a container filling plant in accordance with one possible embodiment.

FIG. 1A shows schematically the main components of one possible embodiment example of a system for filling containers, specifically, a beverage bottling plant for filling bottles 2 with at least one liquid beverage, in accordance with at least one possible embodiment, in which system or plant could possibly be utilized at least one aspect, or several aspects, of the embodiments disclosed herein.

FIG. 1A shows a rinsing arrangement or rinsing station 101, to which the containers, namely bottles 2, are fed in the direction of travel as indicated by the arrow A1, by a first conveyer arrangement 103, which can be a linear conveyor or a combination of a linear conveyor and a starwheel. Downstream of the rinsing arrangement or rinsing station 101, in the direction of travel as indicated by the arrow A1, the rinsed bottles 2 are transported to a beverage filling machine 105 by a second conveyer arrangement 104 that is formed, for example, by one or more starwheels that introduce bottles 2 into the beverage filling machine 105.

The beverage filling machine 105 shown is of a revolving or rotary design, with a rotor 105', which revolves around a central, vertical machine axis. The rotor 105' is designed to receive and hold the bottles 2 for filling at a plurality of filling positions 113 located about the periphery of the rotor 105'. At each of the filling positions 113 is located a filling arrangement 114 having at least one filling device, element, apparatus, or valve. The filling arrangements 114 are designed to introduce a predetermined volume or amount of liquid beverage into the interior of the bottles 2 to a predetermined or desired level.

The filling arrangements 114 receive the liquid beverage material from a toroidal or annular vessel 117, in which a supply of liquid beverage material is stored under pressure by a gas. The toroidal vessel 117 is a component, for example, of the revolving rotor 105'. The toroidal vessel 117 can be connected by means of a rotary coupling or a coupling that permits rotation. The toroidal vessel 117 is also connected to at least one external reservoir or supply of liquid beverage material by a conduit or supply line. In the embodiment shown in FIG. 1A, there are two external supply reservoirs 123 and 124, each of which is configured to store either the same liquid beverage product or different products. These reservoirs 123, 124 are connected to the toroidal or annular vessel 117 by corresponding supply lines, conduits, or arrangements 121 and 122. The external supply reservoirs 123, 124 could be in the form of simple storage tanks, or in the form of liquid beverage product mixers, in at least one possible embodiment.

As well as the more typical filling machines having one toroidal vessel, it is possible that in at least one possible embodiment there could be a second toroidal or annular vessel which contains a second product. In this case, each filling arrangement 114 could be connected by separate connections to each of the two toroidal vessels and have two individually-controllable fluid or control valves, so that in each bottle 2, the first product or the second product can be filled by means of an appropriate control of the filling product or fluid valves.

Downstream of the beverage filling machine 105, in the direction of travel of the bottles 2, there can be a beverage bottle closing arrangement or closing station 106 which closes or caps the bottles 2. The beverage bottle closing arrangement or closing station 106 can be connected by a third conveyer arrangement 107 to a beverage bottle labeling arrangement or labeling station 108. The third conveyor arrangement may be formed, for example, by a plurality of starwheels, or may also include a linear conveyor device.

In the illustrated embodiment, the beverage bottle labeling arrangement or labeling station 108 has at least one labeling unit, device, or module, for applying labels to bottles 2. In the embodiment shown, the labeling arrangement 108 has three output conveyer arrangement: a first output conveyer arrangement 109, a second output conveyer arrangement 110, and a third output conveyer arrangement 111, all of which convey filled, closed, and labeled bottles 2 to different locations.

The first output conveyer arrangement 109, in the embodiment shown, is designed to convey bottles 2 that are filled with a first type of liquid beverage supplied by, for example, the supply reservoir 123. The second output conveyer arrangement 110, in the embodiment shown, is designed to convey bottles 2 that are filled with a second type of liquid beverage supplied by, for example, the supply reservoir 124. The third output conveyer arrangement 111, in the embodiment shown, is designed to convey incorrectly labeled bottles 2. To further explain, the labeling arrangement 108 can comprise at least one beverage bottle inspection or monitoring device that inspects or monitors the location of labels on the bottles 2 to determine if the labels have been correctly placed or aligned on the bottles 2. The third output conveyer arrangement 111 removes any bottles 2 which have been incorrectly labeled as determined by the inspecting device.

The beverage bottling plant can be controlled by a central control arrangement 112, which could be, for example, computerized control system that monitors and controls the operation of the various stations and mechanisms of the beverage bottling plant.

Figure 2:
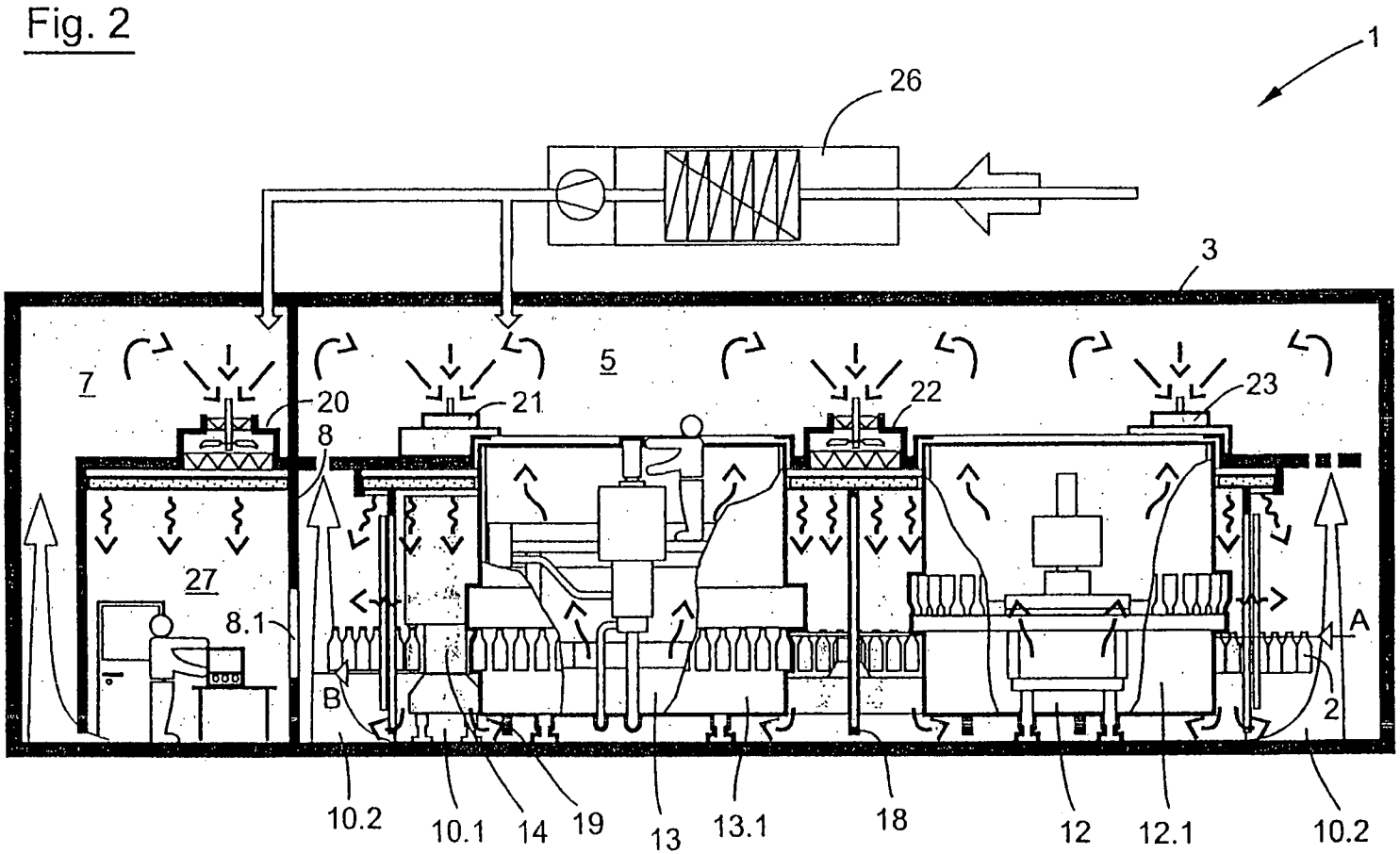
FIG. 2 is a simplified view in elevation of the plant illustrated in FIG. 1, but in a different sectional plane.
Figure 3:
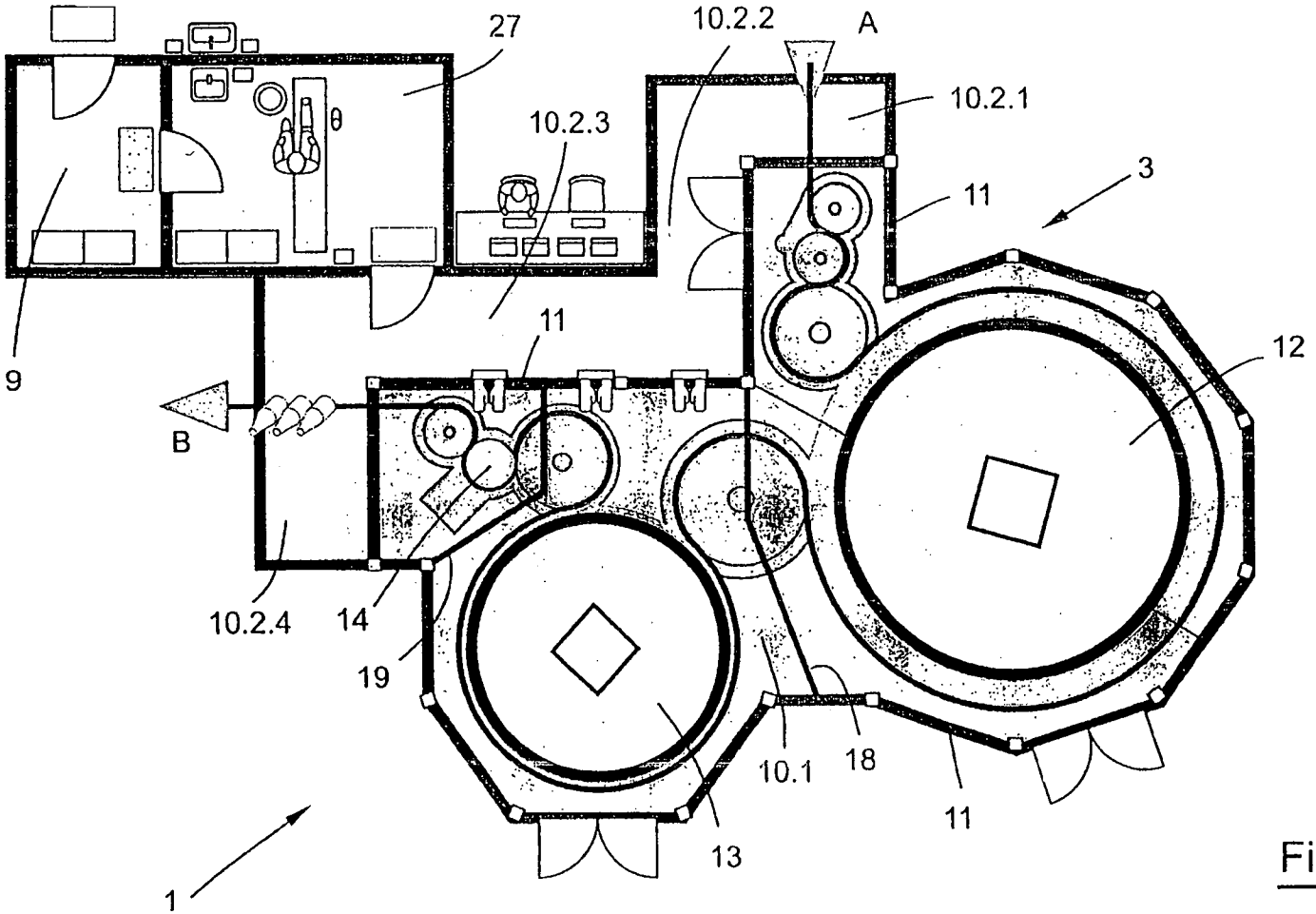
FIG. 3 is a horizontal projection of a plant for the aseptic bottling that is similar to the plant illustrated in FIG. 1.

The plant designated 1 in general in FIGS. 1-3 is used for the aseptic bottling of a liquid in containers or bottles under clean room conditions, for example of a sensitive and/or highly perishable liquid such as a milk product, fruit juice or similar product, for example, or for the bottling of pharmaceutical products.

Please note that the present application was translated from the German language, and therefore may contain some inconsistencies. For instance, reference numeral 4 is referred to as both a "false floor" and a "false ceiling." To clarify, reference numeral 4 is referred to as a "false floor" when the upper portion of the below described bottling plant is being referred to, that is, when reference numeral 4 acts essentially as a floor. In contrast, reference numeral 4 is referred to as a "false ceiling" when the lower portion of the below described bottling plant is being referred to, that is, when reference numeral 4 acts essentially as a ceiling.

The plant 1 comprises essentially an outer housing 3 which encloses an interior which is essentially tightly closed from the exterior, and which is divided into an upper area and a lower area by an accessible false floor 4 (false ceiling). The upper area forms, over the larger portion of the horizontal projection in FIG. 1, a plenum 5 (ceiling space or intermediate room) with access door 5.1 and an auxiliary room 7 which is separated from said plenum 5 by a vertical partition 6. Both the plenum 5 and the auxiliary room 7 are tall enough that said rooms can be entered by persons standing upright, e.g. to perform repair or maintenance work.

The space below the false floor 4 is divided by vertical walls 8 with sealed windows 8.1 into, among other things, a personnel entry airlock 9 and a sterile space 10, which in the plant illustrated in FIG. 1 is located below the plenum 5. For its part, the sterile room 10 is in turn divided by a partition or insulating wall 11 that encloses the machines used in the plant 1 into an inner clean room area 10.1 and an outer security area 10.2.

The partition or insulating wall 11 is realized, at least in part, in the form of a glass wall, so that the machines that are installed in the clean room segment 10.1 are visible from the security area 10.2, and thus the proper operation of these machines, among other things, can be observed.

In the illustrated embodiment, in the clean room area 10.1 there are a rinser 12 which, among other things, sterilizes the bottles 2 that have already been cleaned, a filling machine 13 to fill the sterilized bottles 2 with the liquid to be bottled, a capper 14 to close the bottles and transport devices to transport the bottles 2 between the rinser 12, the filling machine 13 and the capper 14. The rinser 12, the filling machine 13 and the capper 14 are all machines with a rotary design and a rotating rotor.

The empty bottles 2 are fed in the direction indicated by the Arrow A in FIGS. 1-3 by means of a conveyor over the security area 10.2 and through an opening or lock in the wall 11 to the rinser 12. The filled and capped bottles are transported away in the direction indicated by the Arrow B in FIGS. 1-3 by means of the conveyor through an opening or airlock in the wall 11, first into the security area 10.2 and from there out of the housing 3.

The wall 11 hermetically seals the clean room area 10.1, including the vicinity of the underside of the false floor 4, off from the security area. In the vicinity of the floor 15, there are openings 16 in the wall 11 for the passage of air from the clean room area 10.1 into the security area 10.2.

The rinser 12 and the filling machine 13 each have a shield wall or cylindrical shield 12.1 or 13.1 that enclose the respective machine and/or its rotor. These shields are each essentially in the shape of a hollow cylinder that lies with its axis equi-axial with the vertical machine axis and is open on the bottom and top of the machine. Because the machines generally stand on the floor 15 with feet 17, the lower edge or the bottom opening of each shield 12.1 or 13.1 is at some distance from the floor 15, so that between the floor and the lower edge of each shield 12.1 and 13.1 there is a ring-shaped opening for the entry of air from the space surrounding the respective machine into the interior of the shield 12.1 or 13.1. In the vicinity of the upper end, the shields 12.1 and 13.1 are connected in a sealed manner through the false floor 4, where they are covered by a grid or screen 12.2 or 13.2, for example, so that although air can flow out of the interior of the respective cover 12.1 or 13.1 into the plenum 5, the false floor 4 is still accessible in the area of the shields 12.1 and 13.1.

The cylindrical shields 12.1 and 13.1 provide several advantages. In one possible embodiment, the cylindrical shields 12.1 and 13.1 can extend all the way to, and possibly beyond, the false ceiling 4. Such a design essentially encloses the annular space above the rinser and the filling machine, thus minimizing the space of the clean room where sterile air needs to continuously be introduced and to continuously flow. Further, the cylindrical shields 12.1 and 13.1 minimize or substantially reduce the size of the clean room area where sterile air needs to continuously be introduced and to continuously flow. Without the shields 12.1 and 13.1, sterile air would need to occupy a substantially larger area of the clean room, which would require more work from the filters 21, 22, and 23 and the distribution ducts 21.1, 22.1, and 23.1. A smaller area to fill with sterile air would result in lower energy use, lower costs, and less wear and tear on the filters and distribution ducts, possibly resulting in fewer repairs and less maintenance work.

A further advantage of the extension of the cylindrical shields 12.1 and 13.1 to or beyond the false ceiling 4 is that access is permitted to the machines inside the shields for maintenance or repair purposes. Further, since the cylindrical shields 12.1 and 13.1 sit off the floor and create a ring-shaped space around their respective machines, sterile air is permitted to flow from the clean room area surrounding the shields 12.1 and 13.1, through the ring-shaped space. The air then moves upward into the inside of the shields, then out through vents in the false ceiling 4. This special upward flow of sterile air permits repairs or maintenance to be performed to the machines on the inside of the shields 12.1 and 13.1 without contaminating the sterile air in the clean room.

A further advantage of the cylindrical shields 12.1 and 13.1 is the protection of the sterile air in the clean room area from contaminates which may be generated from the rinser or filling machine. Since the rinser and filling machine operate within the confines of the shields 12.1 and 13.1, and the air inside the shields flows up and out through a vent in the false ceiling 4, any airborne contaminates generated by the machines flow out and away from the sterile environment. The machines are effectively substantially sealed off from the clean room area, and any contaminates produced during the machines' operation are essentially kept from entering the clean room area and contaminating the sterilized air therein.

In the clean room area 10.1 there are additional partitions 18 and 19, and in particular a partition 18 between the rinser 12 and the filling machine 13, as well as a partition 19 between the filling machine 13 and the capper 14. In the illustrated embodiment, the partitions each form air passage openings on the floor 15. They also have openings to make possible the transfer of bottles between the individual sections.

In the false floor 4 there are a plurality of filtering devices 20-23 to produce sterile air by filtering. The filtering devices 20-23 are used not only for filtering, but can also be used to heat or cool the air. In addition to a filter and a fan, in such an application there can also be a heating or cooling element that is formed by a heat exchanger.

By means of the filtering device 20, air is sucked out of the auxiliary space 7 and filtered, i.e. it is introduced into the personnel entry airlock 9 in the form of sterile air. In the vicinity of the bottom 15, the personnel entry airlock 9 has an air outlet opening that empties into a vertical air duct 24, by means of which the air can flow out of the personnel entry airlock 9 back into the auxiliary room 7.

With the filter device 21, air is sucked out of the plenum 5 and filtered, i.e. the greater part of it is blown in the form of sterile air into the portion of the clean room area 10.1 that is occupied by the capper 14, and partly also into a hollow cylindrical shield 14.1 of the capper 14, so that the working and capping area of the capper receive a constant flow of with sterile air. A small portion of the filtered sterile air supplied by the filter device 21 gets into the security area 10.2.

From the filtering device 22, air is sucked out of the plenum 5 and introduced filtered in equal parts on both sides of the partition 18, i.e. in the form of sterile air into the portion of the clean room area 10.1 occupied by the rinser 12 and into the area occupied by the filling machine 13. The filtering device 23 also sucks air out of the plenum 5 and introduces it into the portion of the clean room area 10.1 occupied by the rinser 12, and in particular so that at least a portion of the airflow generated by the filtering device 23 flows downward along the inside of the partition 11, and thereby also forms an air curtain at the airlock opening, at which the bottles 2 to be filled are transported in the upright position from the security area 10.2 into the clean room area 10.1 or to the rinser 12. A similar air curtain of filtered and sterile air is also formed at the airlock opening, at which the filled and capped bottles 2 travel out of the clean room area 10.1 into the security area 10.2.

As illustrated by the arrow that represents the airflow, the majority of the airflow generated by the filtering devices 21-23 flows upward via the interior of the shields 12.1 and 13.1 and then returns to the plenum 5 at the top of the respective shield. A portion of the airflow generated by the filtering devices 21-23 also flows through the openings 16 out of the clean room area 10.1 into the security area 10.2 and, like the sterile air from the filtering device 21, is introduced directly into the security area 10.2 and flows back into the plenum 5 via ventilation openings provided in the false floor 4.

In another possible embodiment, a portion of the airflow generated by the filtering devices 21-23 also flows through the openings 16 out of the clean room area 10.1 into the security area 10.2 and, like the sterile air introduced directly into the security area 10.2 by the filtering device 21, flows back into the plenum 5 via at least one ventilation opening provided in the false floor 4.

In the exemplary embodiment illustrated, the filtering devices 21, 22 and 23 have distribution ducts 21.1, 22.1 and 23.1 respectively for an optimal air distribution on the underside of the false floor 4.

By means of the air circulation system formed by the filtering devices 20-23, the spaces that are supplied by these devices are maintained at a specified temperature, for example at a room or air temperature in the range of approximately 20-22° C. and at a specified relative humidity, which can be less than or equal to 70%, for example.

In FIG. 1, 26 is an external air-conditioning unit which, among other things, has a filter stage and an air-conditioning stage, and by means of which the plenum 5 and the auxiliary space 7 are supplied with filtered and air-conditioned fresh air, i.e. air set to a temperature preferably in the range between 20° C. and 22° C. and to a relative humidity of equal to or less than 70%.

The air-conditioning unit 26 as well as the individual filtering devices 20, 21, 22 and 23 are regulated so that the air pressure in the sterile space 10 is in any case higher than atmosphere pressure, and higher than the air pressure in the additional rooms adjacent to the sterile room 10, such as the plenum 5, the auxiliary room 7, the personnel entry airlock 9 etc. The external air-conditioning unit 26 and the filtering devices 20 are also regulated so that the pressure in the plenum 5, in the auxiliary room 7 and in the personnel entry airlock 9 and in the rooms adjacent to them is above the atmospheric pressure outside the housing 3. The air-conditioning unit 26 compensates for the air losses that occur on account of, among other things, the openings for the introduction and removal of containers and caps into and from the clean room.

The plant 1 is designed so that in the clean room 10.1, the Clean Room Class 100 (approximately 35,000 particles per $m^3$ of air) required for aseptic production is achieved. On advantage of the plant 1, among others, is that the sterile space 10 itself has a relatively small volume, which significantly reduces, among other things, the costs for air conditioning and air treatment. An additional essential advantage is that in the event of any operational interruptions, the interiors of the shields 12.1 and 13.1 are accessible, i.e. repair and maintenance interventions can be carried out on the rinser 12 and on the filling machine 13, and namely via the upper cover 12.2 or 13.2 from the plenum 5. Because of the special routing of the airflow out of the areas surrounding the rinser 12 and the filling machine 13 upward through the shields 12.1 and 13.1, in the space 10 outside the shields, i.e. in the sterile area itself, the conditions of Clean Room Class 100 can be maintained even during repairs and maintenance operations on the rinser 12 and on the filling machine 13.

FIG. 2 shows the plant illustrated in FIG. 1 in a modified view in elevation. This figure also shows a working or waiting room 27 for the operating personnel. This room 27, which is also supplied with filtered, sterile air via a filtering device 20 from the auxiliary space 7, is accessible via the personnel entry airlock 9. The room 10 can be reached if necessary from the room 27 or via a corresponding door. In the partition 8 which also separates the room 27 from the room 10, there is also at least one view window 8.1.

FIG. 3 shows, in a somewhat modified form, the horizontal projection of the plant 1*a*. One special feature of this realization is that the security area 10.2 does not completely enclose the clean room area 10.1, but this security area 10.2 is adjacent only to a smaller part of the periphery of the clean room area 10.1, i.e. the wall 11 that encloses the clean room area 10.1 not only forms a partition between the security area 10.2 and the clean room area 10.1, but over the greater part of its length directly seals the clean room area 10.1 off from the environment. This configuration makes a significant contribution to keeping the volume of the space that has to be supplied with sterile and controlled-temperature air as small as possible, which in turns makes it possible to keep the operating costs low.

As shown in FIG. 3, in this realization the secure area 10.2 has a horizontal projection that comprises a plurality of Z or zig-zag shapes and comprises a plurality of segments 10.2.1-10.2.4, each of which is adjacent to another at right angles, whereby the inlet for the bottles 2 is provided in the segment 10.2.1 and the outlet for the filled bottles is provided in the segment 10.2.4, and the conveyor devices (Arrows A and B) for the bottles 2 run at a right angle to each other at the inlet and the outlet.

FIG. 3 further shows the relation of the wall 11 to the cylindrical shields 12.1 and 13.1. In this embodiment, the wall 11 essentially substantially outlines the outer edges of the shields 12.1 and 13.1 of the rinser 12 and the filling machine 13 in order to reduce the amount of open space in the clean room area 10.1. The wall 11 essentially forms a substantially polygonal shape around the outer edges of the shields 12.1 and 13.1. Please note that any number of sides may possibly be used to form the essentially polygonal outline of the shields 12.1 and 13.1. Further, the wall 11 may be rounded around the edges of the shields 12.1 and 13.1 instead of having a polygonal shape. The embodiment of the wall 11 in FIG. 3 is not meant to limit the shape of the wall 11 in any way, as other shapes and embodiments of the wall 11 are possible.

Figure 3A:
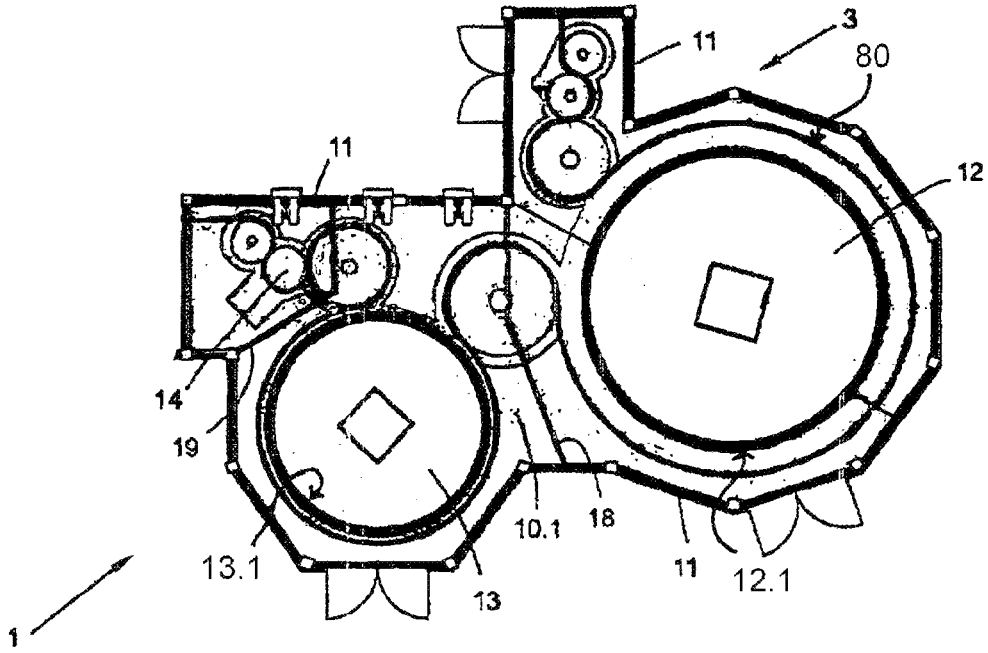
FIG. 3A shows more detail of the clean room area shown in FIG. 3.

FIG. 3A shows further detail of the area within the wall 11. In order to minimize the amount of space in the clean room area 10.1, the shields 12.1 and 13.1 enclose the rinser 12 and the filling machine 13, essentially closing the machines off from the clean room area 10.1. Further, the wall 11 essentially outlines the outer portions of the shields 12.1 and 13.1, further minimizing the area of the clean room 10.1 that needs to be provided with sterile air. FIG. 3A also clearly shows that the rotor 80 is disposed on the outside of the shields 12.1 and 13.1 and runs about most of the perimeter of the shields 12.1 and 13.1.

Figure 3B:
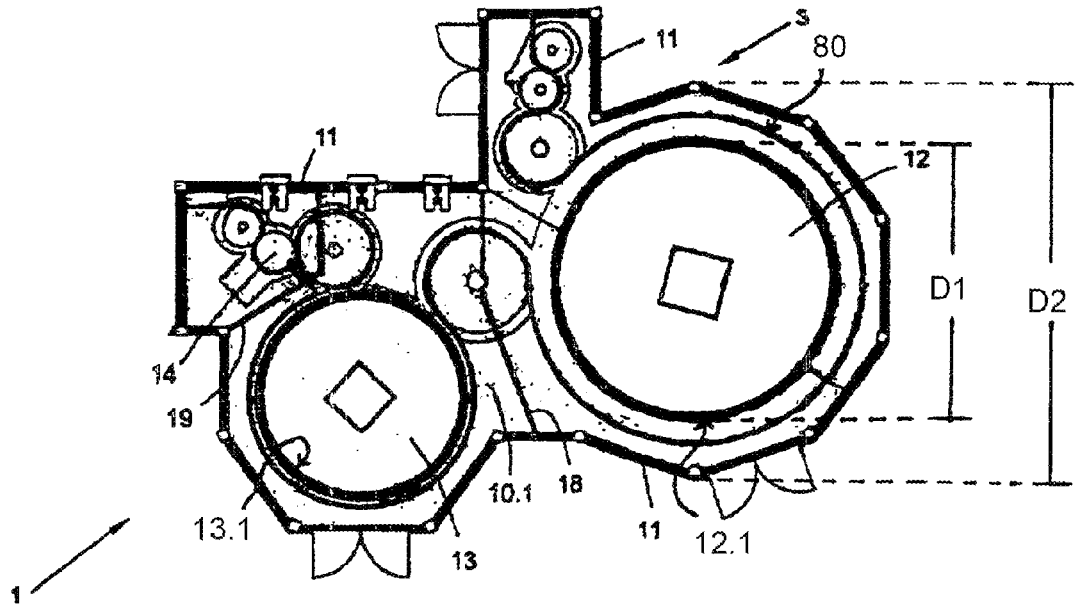
FIG. 3B shows more detail of the clean room area shown in FIG. 3.

As shown in FIG. 3B, in order to minimize the amount of unnecessary or wasted space inside the clean room 10.1, the ratio of the diameter D1 of the shields 12.1 and 13.1 to the diameter D2 of the wall 11 that surrounds the shields 12.1 and 13.1 could possibly be between 0.60, 0.61, 0.62, 0.63, 0.64, 0.65, 0.66, 0.67, 0.68, 0.69, 0.70, 0.71, 0.72, 0.73, 0.74, 0.75, 0.76, 0.77, 0.78, 0.79, 0.80, 0.81, 0.82, 0.83, 0.84, 0.85, 0.86, 0.87, 0.88, 0.89, and 0.90. Please note that the ratios listed above are only possible examples of the relationship of the shields 12.1 and 13.1 and the wall 11. The ratio may be smaller or larger in other possible embodiments.

Figure 4:
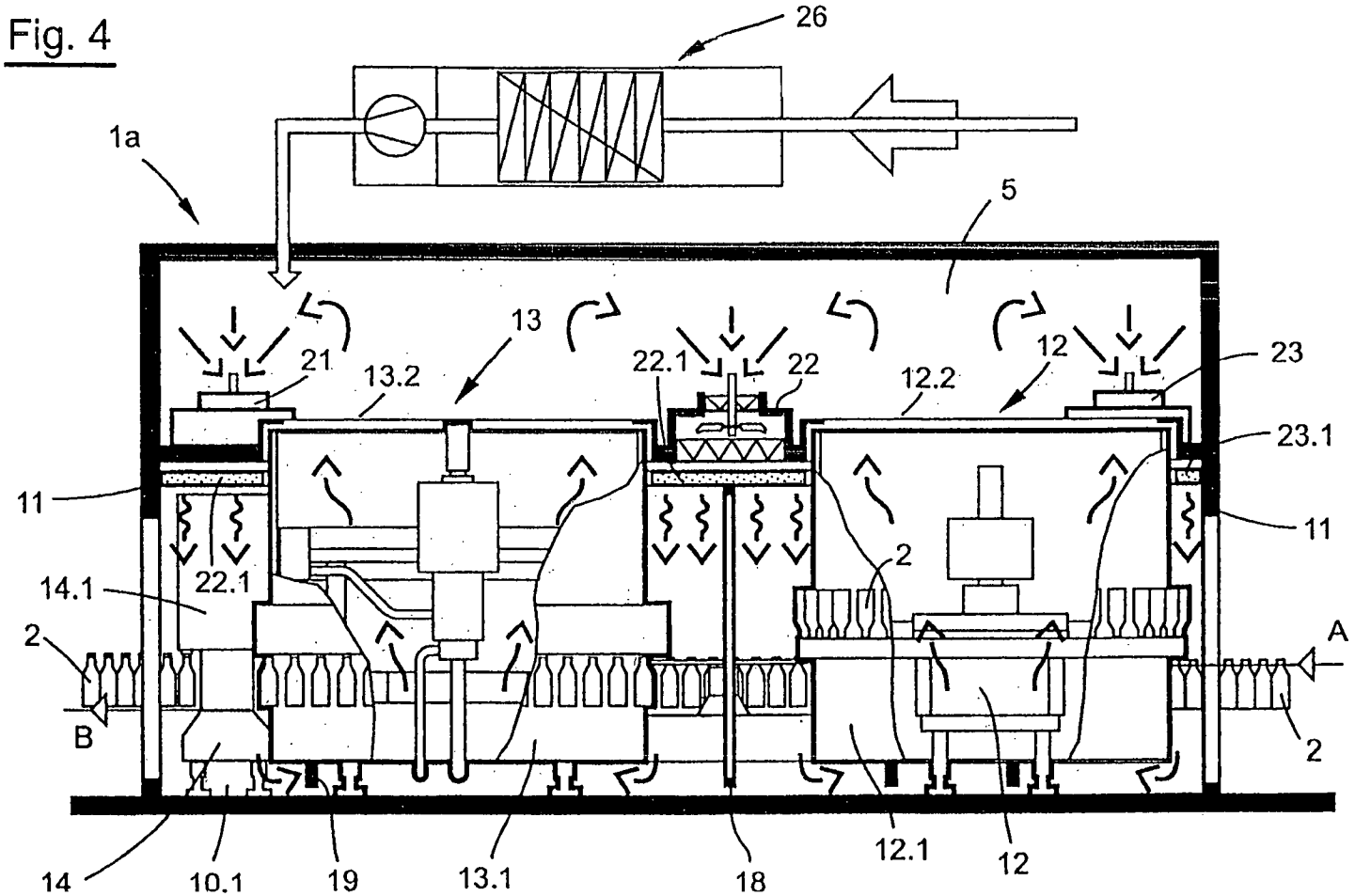
FIGS. 4 and 5 are illustrations similar to FIG. 1 and show additional possible realizations of the plant claimed by the present application.

FIG. 4 shows an additional possible realization in the form of a plant 1*a* in which the housing 3 is realized in a simplified manner, and has only the plenum 5 and the sterile room 10 located underneath the false floor 4. The peripheral wall of the sterile room in this embodiment is formed by the wall 11 that encloses the clean room area 10.1.

The security area 10.2 and other spaces, such as for example the personnel entry airlock 9 or the room 27, are not present. The operation of the plant 1, in particular of the rinser 12, the filling machine 13 and the capping machine 14, can be monitored visually through windows in the wall 11. The plant 1*a* is suitable for use in a bottling plant.

Figure 5:
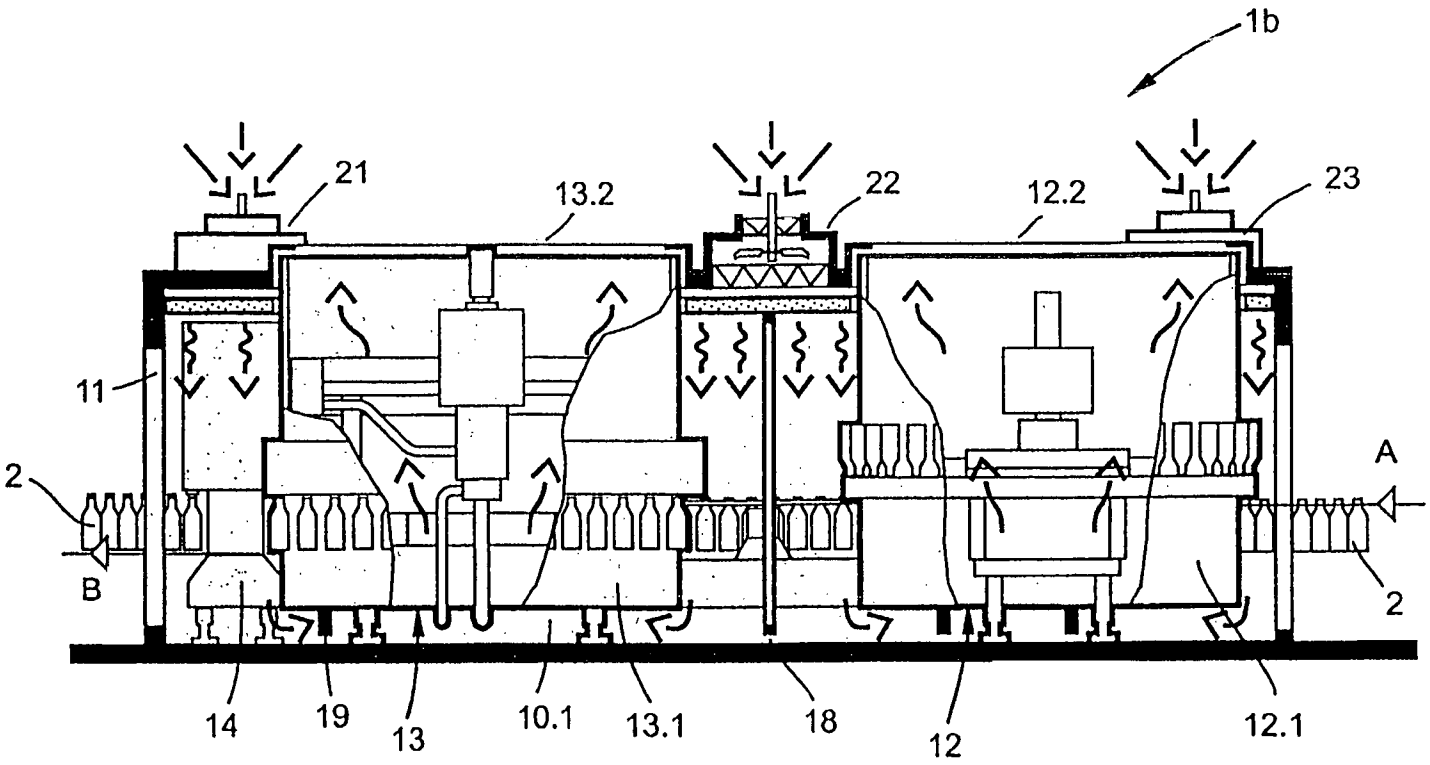

FIG. 5 shows, in a presentation that is similar to FIG. 1, an additional possible realization with a plant 1*b* which differs from the plant 1*a* in that only the clean room area 10.1 is present, and the housing is therefore limited to the wall 11 that encloses this clean room area 10.1, the false floor 4 and the lower floor 15. In this embodiment, too, which is intended to be installed in a bottling building, the clean room area 10.1 can be sealed almost airtight from the outside. By means of the filtering devices 21-23, outside air is filtered and blown into the clean room area 10.1 in the form of sterile air. The air flow again runs upward through the interiors of the shields 12.1 and 13.1, whereby the air exits into the production or bottling building at the top of these shields. The bottling building can be air conditioned by means of an air conditioning and filtration device, for example, which is not shown.

Figure 6:
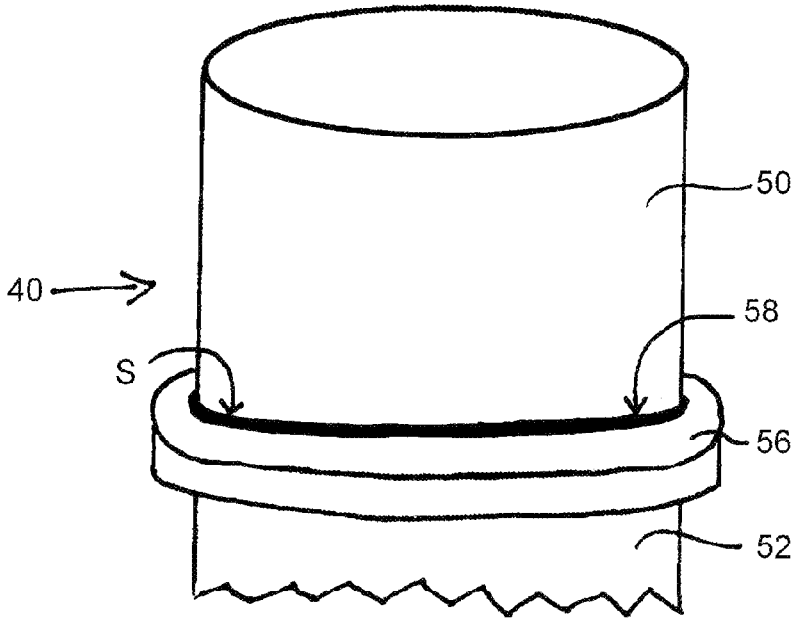
FIG. 6 is a detailed view of the cylindrical shield enclosing the rinser or filling machine, according to one possible embodiment.

FIG. 6 shows a more detailed view of a cylindrical shield 40 enclosing a machine, such as a rinser or filling machine, according to one possible embodiment. The cylindrical shield 40 comprises an upper portion 50 and a lower portion 52. The upper portion 50 and the lower portion 52 are separated by a space S, through which space S the rotor 56 of a respective machine, such as a rinser or a filling machine, projects out horizontally.

In one possible embodiment, the space S may be sealed by a sealing element 58, such as an elastic sealing element, so that essentially no air is permitted to flow between the edge of the upper portion 50 of the shield 40 and the adjacent upper surface of the rotor 56. Similarly, another sealing element 58 could be located between the edge of the lower portion 52 of the shield 40 and the adjacent lower surface of the rotor 56. In another possible embodiment, the sealing elements 58 may be omitted, and the space S may be configured such that it substantially only allows enough room for the rotor 56 to project out through the shield 40. Specifically, the edge of the upper portion 50 could be positioned at a minimal distance, such as 0.25, 0.50, or 0.75 inch, away from the adjacent upper surface of the rotor 56 in order to minimize the flow of air through the space. The edge of the lower portion 52 could be similarly positioned with respect to the adjacent lower surface of the rotor 56.

Please note that the embodiment shown in FIG. 6 is not drawn to scale, and that any measurements or dimensions are possible, depending on the size of the machine housed inside the cylindrical shield 40. Further, the position of the space S between the upper portion 50 and the lower portion 40 and the rotor 56 may be lower or higher on the cylindrical shield 40, depending on the size of the machine housed inside the shield.

Figure 7:
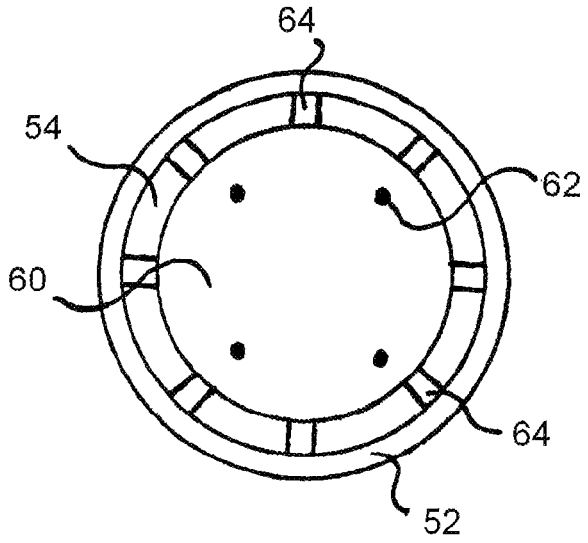
FIG. 7 is a view from the bottom of the rinser or filling machine and the shield enclosing it, according to one possible embodiment.
Figure 8:
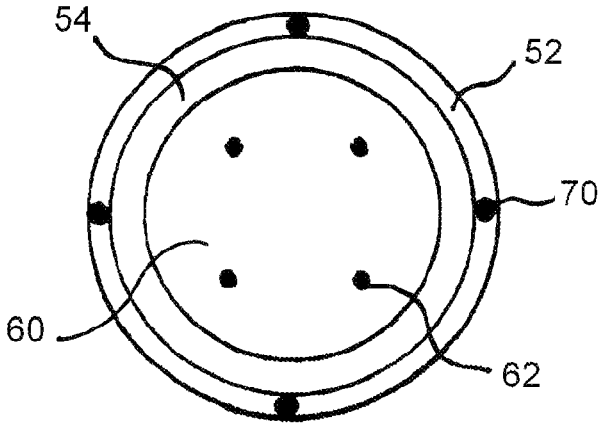
FIG. 8 is similar to FIG. 7 and shows an alternate possible embodiment of the shield enclosing the rinser or filling machine.

Since, as shown in FIG. 6, the shield 40 is divided into two separate shield portions 50, 52, each of the shield portions 50, 52 must be affixed to some structure to support the shield portions 50, 52. In one possible embodiment, the upper portion 50 is affixed to the ceiling of a clean room or bottling plant. In another possible embodiment, the upper portion 50 could be affixed to the filling or rinsing machine which the upper portion 50 partially encloses, such as by connecting pieces or arms, or by a bearing system connected to the rotor 56. FIGS. 7 and 8 show possible embodiments of support structures for the lower portion 52 of the shield 40.

FIG. 7 shows a bottom view of a machine 60, for example, a rinser or filling machine, housed by a cylindrical shield 40. The machine 60 is supported by feet 62. The lower shield portion 52 is mounted on the machine 60 by means of connecting pieces or arms 64. A ring-shaped gap 54 between the lower shield portion 52 and the machine 60 can be clearly seen in FIG. 7, which ring-shaped gap 54 permits the flow of air between the lower shield portion 52 and the machine 60 into the annular space about the machine 60 enclosed by the shield 40. Please note that any number of connecting pieces or arms 64 may possibly be used to mount the lower shield portion 52 to the machine 60. The number of connecting pieces or arms 64 used in FIG. 7 is for illustrative purposes only, and is not meant to limit other possible embodiments in any way.

FIG. 8 is similar to FIG. 7, and shows an alternate embodiment where the lower portion 52 of the cylindrical shield 40 has legs 70 to hold the lower portion 52 off the ground. In this embodiment, the lower shield portion 52 does not require connecting pieces or arms 64 to mount it to the machine 60, since the legs 70 support the lower portion 52 separate from the machine 60.

Please also note that the cylindrical shield 40 may be of any thickness, and the embodiments shown in FIGS. 7 and 8 are for exemplary purposes only to illustrate possible support structures to support the lower shield portion 52. Further, the ring-shaped gap 54 may be wider or narrower in other possible embodiments. The embodiments shown in FIGS. 7 and 8 are not meant to limit other possible embodiments in any way, and are included for illustrative purposes only.

The embodiments are described above on the basis of exemplary embodiments. It goes without saying that numerous modifications and variations can be made without thereby going beyond the teaching of the present application.

The present application teaches a plant for bottling under enhanced hygienic air conditions and/or for the aseptic bottling of a liquid in bottles or similar containers has, among other things, a clean room area that is sealed from the outside airtight or almost airtight by at least one wall, which clean room contains at least one filling machine and one capping machine to cap the filled containers in the clean room area, at least one filtering device for the introduction of filtered and sterile air into the clean room area and with at least one air outlet in the vicinity of a ceiling on the top. A shield that at least partly encloses the filling machine and/or the capping machine or a rotor of the filling machine and/or of the capper forms a return air duct that is in communication with the at least one air outlet or forms said air outlet.

One feature or aspect of an embodiment is believed at the time of the filing of this patent application to possibly reside broadly in a plant for bottling under enhanced hygienic air conditions and/or for the aseptic bottling of a liquid in bottles or similar containers, with a clean room area that is sealed from the outside airtight or almost airtight by at least one wall, which clean room contains at least one filling machine and one capping machine that is downstream from the filling machine in the direction of transport of the containers to cap the filled containers in the clean room area, with at least one filtering device for the introduction of filtered and sterile air into the clean room area and with at least one air outlet in the vicinity of a ceiling that delimits the clean room area on the top, characterized by the fact that a shield that at least partly encloses the filling machine and/or the capping machine or a rotor of the filling machine and/or of the capper forms a return air duct that is in communication with the at least one air outlet or forms said air outlet.

Another feature or aspect of an embodiment is believed at the time of the filing of this patent application to possibly reside broadly in a plant for bottling under enhanced hygienic air conditions and/or for the aseptic bottling of a liquid in bottles or similar containers, characterized by the fact that in the clean room area, in the direction of transport of the containers, upstream of the capping machine, there is at least one additional handling machine for the containers, e.g. for the additional cleaning and/or sterilization of the containers, for example a rinser, and that a shield that encloses a rotating rotor of said handling machine, with its interior, also forms a return air duct that is in communication with an outlet opening.

Yet another feature or aspect of an embodiment is believed at the time of the filing of this patent application to possibly reside broadly in a plant for bottling under enhanced hygienic air conditions and/or for the aseptic bottling of a liquid in bottles or similar containers, characterized by the fact that the clean room area is divided by at least one partition or intermediate wall at least into separate sub-rooms that contain the filling machine and the capper, as well as preferably also into a sub-room that contains the additional treatment machine.

Still another feature or aspect of an embodiment is believed at the time of the filing of this patent application to possibly reside broadly in a plant for bottling under enhanced hygienic air conditions and/or for the aseptic bottling of a liquid in bottles or similar containers, characterized by the fact that the partitions or intermediate walls that separate the sub-rooms from each other have passage openings for the conveyor system as well as air passage openings, which can be in the vicinity of a floor of the clean room area, for example.

A further feature or aspect of an embodiment is believed at the time of the filing of this patent application to possibly reside broadly in a plant for bottling under enhanced hygienic air conditions and/or for the aseptic bottling of a liquid in bottles or similar containers, characterized by the fact that each sub-room of the clean room area is supplied separately with sterile air by means of at least one filtering device.

Another feature or aspect of an embodiment is believed at the time of the filing of this patent application to possibly reside broadly in a plant for bottling under enhanced hygienic air conditions and/or for the aseptic bottling of a liquid in bottles or similar containers, characterized by the fact that the wall that encloses the clean room area separates the clean room area from a security area, which is also supplied with filtered, sterile air by means of the at least one filtering device.

Yet another feature or aspect of an embodiment is believed at the time of the filing of this patent application to possibly reside broadly in a plant for bottling under enhanced hygienic air conditions and/or for the aseptic bottling of a liquid in bottles or similar containers, characterized by the fact that the security area has its own air outlet opening.

Still another feature or aspect of an embodiment is believed at the time of the filing of this patent application to possibly reside broadly in a plant for bottling under enhanced hygienic air conditions and/or for the aseptic bottling of a liquid in bottles or similar containers, characterized by the fact that the security area extends only along a portion of the periphery of the clean room area.

A further feature or aspect of an embodiment is believed at the time of the filing of this patent application to possibly reside broadly in a plant for bottling under enhanced hygienic air conditions and/or for the aseptic bottling of a liquid in bottles or similar containers, characterized by the fact that the wall that surrounds the clean room area is made at least in some areas of glass or a glass-like material, such as glass-like plastic, for example.

Another feature or aspect of an embodiment is believed at the time of the filing of this patent application to possibly reside broadly in a plant for bottling under enhanced hygienic air conditions and/or for the aseptic bottling of a liquid in bottles or similar containers, characterized by the fact that the at least one filtering device and/or the at least one air outlet opening are provided on a floor or false floor that encloses the clean room on the upper side.

Yet another feature or aspect of an embodiment is believed at the time of the filing of this patent application to possibly reside broadly in a plant for bottling under enhanced hygienic air conditions and/or for the aseptic bottling of a liquid in bottles or similar containers, characterized by the fact that the shields are each formed by a wall that surrounds a vertical machine axis.

Still another feature or aspect of an embodiment is believed at the time of the filing of this patent application to possibly reside broadly in a plant for bottling under enhanced hygienic air conditions and/or for the aseptic bottling of a liquid in bottles or similar containers, characterized by the fact that the shields are realized in the shape of a hollow cylinder.

A further feature or aspect of an embodiment is believed at the time of the filing of this patent application to possibly reside broadly in an apparatus for bottling under enhanced hygienic air conditions and/or for the aseptic bottling of a liquid in bottles or similar containers, characterized by an entry lock that is formed in a housing of the plant and/or an additional room that is formed in the housing of the plant and is closed toward the outside, and by at least one additional filtering device and at least one additional air outlet for the personnel entry airlock and/or for the additional room, preferably in the vicinity of the floor of the personnel entry airlock and/or of the additional room.

Another feature or aspect of an embodiment is believed at the time of the filing of this patent application to possibly reside broadly in a plant for bottling under enhanced hygienic air conditions and/or for the aseptic bottling of a liquid in bottles or similar containers, characterized by the fact that at least the filtering devices that supply the clean room area and/or the security area with sterile air are located with their air inlets in an intermediate space or plenum that is closed on the outside.

Yet another feature or aspect of an embodiment is believed at the time of the filing of this patent application to possibly reside broadly in a plant for bottling under enhanced hygienic air conditions and/or for the aseptic bottling of a liquid in bottles or similar containers, characterized by the fact that the at least one air outlet opening of the clean room area and/or of the safety area empties into the plenum.

Still another feature or aspect of an embodiment is believed at the time of the filing of this patent application to possibly reside broadly in a plant for bottling under enhanced hygienic air conditions and/or for the aseptic bottling of a liquid in bottles or similar containers, characterized by the fact that the at least one filtering device for the supply of the personnel entry airlock and/or of the additional room is in communication via its air inlet with an auxiliary room, and that the at least one air outlet of the personnel entry airlock and/or of the additional room empties into this auxiliary room.

A further feature or aspect of an embodiment is believed at the time of the filing of this patent application to possibly reside broadly in a plant for bottling under enhanced hygienic air conditions and/or for the aseptic bottling of a liquid in bottles or similar containers, characterized by the fact that the plenum and/or the auxiliary room are provided above a false ceiling, and that the clean room area and/or the security area and/or the personnel entry airlock and/or the additional room are located on a level below the false ceiling.

Another feature or aspect of an embodiment is believed at the time of the filing of this patent application to possibly reside broadly in a plant for bottling under enhanced hygienic air conditions and/or for the aseptic bottling of a liquid in bottles or similar containers, characterized by an air conditioning and filtering device for the supply of the plenum and/or of the auxiliary room with dehumidified and air conditioned air.

Yet another feature or aspect of an embodiment is believed at the time of the filing of this patent application to possibly reside broadly in a plant for bottling under enhanced hygienic air conditions and/or for the aseptic bottling of a liquid in bottles or similar containers, characterized by the fact that the at least one filtering device is in communication via its air inlet with the environment.

Still another feature or aspect of an embodiment is believed at the time of the filing of this patent application to possibly reside broadly in a plant for bottling under enhanced hygienic air conditions and/or for the aseptic bottling of a liquid in bottles or similar containers, characterized by the fact that the at least one filtering device, in addition to a filter, also has at least one motor-driven fan, preferably also a heat exchanger through which the air can flow to cool or heat the air.

A further feature or aspect of an embodiment is believed at the time of the filing of this patent application to possibly reside broadly in a plant for bottling under enhanced hygienic air conditions and/or for the aseptic bottling of a liquid in bottles or similar containers, characterized by the fact that the shields are made at least partly of transparent material.

The components disclosed in the various publications, disclosed or incorporated by reference herein, may possibly be used in possible embodiments of the present invention, as well as equivalents thereof.

Some examples of aseptic bottling systems and components thereof that may possibly be used or adapted for use in at least one possible embodiment may possibly be found in the following publications: Federal Republic of Germany patents and patent applications DE-PS 696 569; DE 199 11 517 A1; DE 198 35 369 C1; DE 197 31 796; DE 101 45 803 A1; and DE 297 13 155 U1; and European patent EP 0120 789.

The purpose of the statements about the technical field is generally to enable the Patent and Trademark Office and the public to determine quickly, from a cursory inspection, the nature of this patent application. The description of the technical field is believed, at the time of the filing of this patent application, to adequately describe the technical field of this patent application. However, the description of the technical field may not be completely applicable to the claims as originally filed in this patent application, as amended during prosecution of this patent application, and as ultimately allowed in any patent issuing from this patent application. Therefore, any statements made relating to the technical field are not intended to limit the claims in any manner and should not be interpreted as limiting the claims in any manner.

Some examples of bottling and container handling systems and components thereof which may possibly be utilized or adapted for use in at least one possible embodiment, may possibly be found in the following U.S. Pat. No. 6,484,477, entitled "Capping Machine for Capping and Closing Containers, and a Method for Closing Containers;" U.S. Pat. No. 6,474,368, entitled "Beverage Container Filling Machine, and Method for Filling Containers with a Liquid Filling Material in a Beverage Container Filling Machine;" U.S. Pat. No. 6,494,238, entitled "A Plant for Filling Beverage into Beverage Bottles Other Beverage Containers Having Apparatus for Replacing Remaining Air Volume in Filled Beverage Bottles or Other Beverage Containers;" U.S. Pat. No. 6,470,922, entitled "Apparatus for the Recovery of an Inert Gas;" U.S. Pat. No. 6,463,964, entitled "Method of Operating a Plant for Filling Bottles, Cans or the like Beverage Containers with a Beverage, and a Beverage Container Filling Machine;" U.S. Pat. No. 6,834,473, entitled "Bottling Plant and Method of Operating a Bottling Plant and a Bottling Plant with Sections for Stabilizing the Bottled Product;" U.S. Pat. No. 6,484,762, entitled "A Filling System with Post-dripping Prevention;" and U.S. Pat. No. 6,668,877, entitled "Filling System for Still Beverages."

Some examples of bottling and container handling systems and components thereof which may possibly be utilized or adapted for use in at least one possible embodiment, may possibly be found in the following U.S. patent application Ser. No. 10/653,617, filed on Sep. 2, 2003, entitled "Labeling Machine with a Sleeve Mechanism for Preparing and Applying Cylindrical Labels onto Beverage Bottles and Other Beverage Containers in a Beverage Container Filling Plant;" Ser. No. 10/666,931, filed on Sep. 18, 2003, entitled "Beverage Bottling Plant for Filling Bottles with a Liquid Beverage Filling Material and a Labelling Station for Filled Bottles and Other Containers;" Ser. No. 10/723,451, filed on Nov. 26, 2003, entitled "Beverage Bottling Plant for Filling Beverage Bottles or Other Beverage Containers with a Liquid Beverage Filling Material and Arrangement for Dividing and Separating of a Stream of Beverage Bottles or Other Beverage Containers;" Ser. No. 10/739,895, filed on Dec. 18, 2003, entitled "Method of Operating a Beverage Container Filling Plant with a Labeling Machine for Labeling Beverage Containers Such as Bottles and Cans, and a Beverage Container Filling Plant with a Labeling Machine for Labeling Beverage Containers Such as Bottles and Cans;" Ser. No. 10/756,171, filed on Jan. 13, 2004, entitled "A Beverage Bottling Plant for Filling Bottles and like Containers with a Liquid Beverage Filling Material and a Conveyer Arrangement for Aligning and Distributing Packages Containing Filled Bottles and like Containers;" Ser. No. 10/780,280, entitled "A Beverage Bottling Plant for Filling Bottles with a Liquid Beverage Filling Material, a Container Filling Plant Container Information Adding Station, Such As, a Labeling Station, Configured to Add Information to Containers, Such As, Bottles and Cans, and Modules for Labeling Stations;" Ser. No. 10/786,256, entitled "A Beverage Bottling Plant for Filling Bottles with a Liquid Beverage Filling Material, and a Container Filling Lifting Device for Pressing Containers to Container Filling Machines;" Ser. No. 10/793,659, entitled "A Beverage Bottling Plant for Filling Bottles with a Liquid Beverage Filling Material, and a Container Filling Plant Container Information Adding Station, Such As, a Labeling Station Having a Sleeve Label Cutting Arrangement, Configured to Add Information to Containers, Such As, Bottles and Cans;" Ser. No. 10/801,924, filed on Mar. 16, 2004, entitled "Beverage Bottling Plant for Filling Bottles with a Liquid Beverage Filling Material, and a Cleaning Device for Cleaning Bottles in a Beverage Bottling Plant;" Ser. No. 10/813,651, filed on Mar. 30, 2004, entitled "A Beverage Bottling Plant for Filling Bottles with a Liquid Beverage Filling Material, and an Easily Cleaned Lifting Device in a Beverage Bottling Plant;" Ser. No. 10/814,624, filed on Mar. 31, 2004, entitled "A Beverage Bottling Plant for Filling Bottles with a Liquid Beverage Filling Material, and a Container Filling Plant Container Information Adding Station, Such As, a Labeling Station Having a Gripper Arrangement, Configured to Add Information to Containers, Such As, Bottles and Cans;" Ser. No. 10/816,787, filed on Apr. 2, 2004, entitled "A Beverage Bottling Plant for Filling Bottles with a Liquid Beverage Filling Material, and Apparatus for Attaching Carrying Grips to Containers with Filled Bottles;" Ser. No. 10/865,240, filed on Jun. 10, 2004, entitled "A Beverage Bottling Plant for Filling Bottles with a Liquid Beverage Filling Material, a Beverage Container Filling Machine, and a Beverage Container Closing Machine;" Ser. No. 10/883,591, filed on Jul. 1, 2004, entitled "A Beverage Bottling Plant for Filling Bottles with a Liquid Beverage Filling Material Having a Container Filling Plant Container Information Adding Station, Such As, a Labeling Station, Configured to Add Information to Containers, Such As, Bottles and Cans, and Modules for Labeling Stations and a Bottling Plant Having a Mobile Module Carrier;" Ser. No. 10/930,678, filed on Aug. 31, 2004, entitled "A Beverage Bottling Plant for Filling Bottles with a Liquid Beverage Filling Material, a Container Filling Plant Container Filling Machine, and a Filter Apparatus for Filtering a Liquid Beverage;" Ser. No. 10/931,817, filed on Sep. 1, 2004, entitled "A Beverage Bottling Plant for Filling Bottles with a Liquid Beverage Filling Material, Having an Apparatus for Exchanging Operating Units Disposed at Rotating Container Handling Machines;" Ser. No. 10/939,170, filed on Sep. 10, 2004; Ser. No. 10/954,012, filed on Sep. 29, 2004; Ser. No. 10/952,706; Ser. No. 10/962,183, filed on Oct. 8, 2004; Ser. No. 10/967,016, filed on Oct. 15, 2004; Ser. No. 10/982,706, filed on Nov. 5, 2004; Ser. No. 10/982,694; Ser. No. 10/982,710; Ser. No. 10/984,677, filed on Nov. 9, 2004; Ser. No. 10/985,640, filed on Nov. 10, 2004; Ser. No. 11/004,663, filed on Dec. 3, 2004; Ser. No. 11/009,551, filed on Dec. 10, 2004; Ser. No. 11/012,859, filed on Dec. 15, 2004; Ser. No. 11/014,673, filed on Dec. 16, 2004; Ser. No. 11/016,364, filed on Dec. 17, 2004; and Ser. No. 11/016,363.

The appended drawings in their entirety, including all dimensions, proportions and/or shapes in at least one embodiment of the invention, are accurate and are hereby included by reference into this specification.

Some examples of stepping motors that may possibly be utilized or possibly adapted for use in at least one possible embodiment of the present application may possibly be found in the following U.S. Pat. No. 6,348,774 issued to Andersen et al. on Feb. 19, 2002; U.S. Pat. No. 6,373,209 issued to Gerber et al. on Apr. 16, 2002; U.S. Pat. No. 6,424,061 issued to Fukuda et al. on Jul. 23, 2002; U.S. Pat. No. 6,509,663 issued to Aoun on Jan. 21, 2003; U.S. Pat. No. 6,548,923 to Ohnishi et al. on Apr. 15, 2003; and U.S. Pat. No. 6,661,193 issued to Tsai on Dec. 9, 2003.

The background information is believed, at the time of the filing of this patent application, to adequately provide background information for this patent application. However, the background information may not be completely applicable to the claims as originally filed in this patent application, as amended during prosecution of this patent application, and as ultimately allowed in any patent issuing from this patent application. Therefore, any statements made relating to the background information are not intended to limit the claims in any manner and should not be interpreted as limiting the claims in any manner.

All, or substantially all, of the components and methods of the various embodiments may be used with at least one embodiment or all of the embodiments, if more than one embodiment is described herein.

Some examples of bottling systems that may possibly be utilized or possibly adapted for use in at least one possible embodiment of the present application may possibly be found in the following U.S. patents, all assigned to the Assignee herein, namely: U.S. Pat. Nos. 4,911,285; 4,944,830; 4,950,350; 4,976,803; 4,981,547; 5,004,518; 5,017,261; 5,062,917; 5,062,918; 5,075,123; 5,078,826; 5,087,317; 5,110,402; 5,129,984; 5,167,755; 5,174,851; 5,185,053; 5,217,538; 5,227,005; 5,413,153; 5,558,138; 5,634,500; 5,713,403; 6,276,113; 6,213,169; 6,189,578; 6,192,946; 6,374,575; 6,365,054; 6,619,016; 6,474,368; 6,494,238; 6,470,922; and 6,463,964.

The purpose of the statements about the object or objects is generally to enable the Patent and Trademark Office and the public to determine quickly, from a cursory inspection, the nature of this patent application. The description of the object or objects is believed, at the time of the filing of this patent application, to adequately describe the object or objects of this patent application. However, the description of the object or objects may not be completely applicable to the claims as originally filed in this patent application, as amended during prosecution of this patent application, and as ultimately allowed in any patent issuing from this patent application. Therefore, any statements made relating to the object or objects are not intended to limit the claims in any manner and should not be interpreted as limiting the claims in any manner.

Some examples of sensors that may possibly be utilized or possibly adapted for use in at least one possible embodiment of the present application may possibly be found in the following U.S. Pat. No. 6,062,248 issued to Boelkins on May 16, 2000; U.S. Pat. No. 6,223,593 issued to Kubisiak et al. on May 1, 2001; U.S. Pat. No. 6,466,035 issued to Nyfors et al. on Oct. 15, 2002; U.S. Pat. No. 6,584,851 issued to Yamagishi et al. on Jul. 1, 2003; U.S. Pat. No. 6,631,638 issued to James et al. on Oct. 14, 2003; and U.S. Pat. No. 6,707,307 issued to McFarlane et al. on Mar. 16, 2004.

All of the patents, patent applications and publications recited herein, and in the Declaration attached hereto, are hereby incorporated by reference as if set forth in their entirety herein.

The summary is believed, at the time of the filing of this patent application, to adequately summarize this patent application. However, portions or all of the information contained in the summary may not be completely applicable to the claims as originally filed in this patent application, as amended during prosecution of this patent application, and as ultimately allowed in any patent issuing from this patent application. Therefore, any statements made relating to the summary are not intended to limit the claims in any manner and should not be interpreted as limiting the claims in any manner.

Some examples of servo-motors that may possibly be utilized or possibly adapted for use in at least one possible embodiment of the present application may possibly be found in the following U.S. Pat. No. 4,050,434 issued to Zbikowski et al. on Sep. 27, 1977; U.S. Pat. No. 4,365,538 issued to Andoh on Dec. 28, 1982; U.S. Pat. No. 4,550,626 issued to Brouter on Nov. 5, 1985; U.S. Pat. No. 4,760,699 issued to Jacobsen et al. on Aug. 2, 1988; U.S. Pat. No. 5,076,568 issued to de Jong et al. on Dec. 31, 1991; and U.S. Pat. No. 6,025 issued to Yasui on Feb. 15, 2000.

It will be understood that the examples of patents, published patent applications, and other documents which are included in this application and which are referred to in paragraphs which state "Some examples of . . . which may possibly be used in at least one possible embodiment of the present application . . . " may possibly not be used or useable in any one or more embodiments of the application.

The sentence immediately above relates to patents, published patent applications and other documents either incorporated by reference or not incorporated by reference.

Some examples of bottling systems which may possibly be utilized or adapted for use in at least one possible embodiment may possibly be found in the following U.S. Pat. No. 6,684,602, entitled "Compact bottling machine;" U.S. Pat. No. 6,470,922, entitled "Bottling plant for bottling carbonated beverages;" U.S. Pat. No. 6,390,150, entitled "Drive for bottling machine;" U.S. Pat. No. 6,374,575, entitled "Bottling plant and method of operating a bottling plant;" U.S. Pat. No. 6,192,946, entitled "Bottling system;" U.S. Pat. No. 6,185,910, entitled "Method and an apparatus for high-purity bottling of beverages;" U.S. Pat. No. 6,058,985, entitled "Bottling machine with a set-up table and a set-up table for a bottling machine and a set-up table for a bottle handling machine;" U.S. Pat. No. 5,996,322, entitled "In-line bottling plant;" U.S. Pat. No. 5,896,899, entitled "Method and an apparatus for sterile bottling of beverages;" U.S. Pat. No. 5,848,515, entitled "Continuous-cycle sterile bottling plant;" U.S. Pat. No. 5,634,500, entitled "Method for bottling a liquid in bottles or similar containers;" and U.S. Pat. No. 5,425,402, entitled "Bottling system with mass filling and capping arrays."

Some examples of starwheels which may possibly be utilized or adapted for use in at least one possible embodiment may possibly be found in the following U.S. Pat. No. 5,613,593, entitled "Container handling starwheel;" U.S. Pat. No. 5,029,695, entitled "Improved starwheel;" U.S. Pat. No. 4,124,112, entitled "Odd-shaped container indexing starwheel;" and U.S. Pat. No. 4,084,686, entitled "Starwheel control in a system for conveying containers."

The corresponding foreign and international patent publication applications, namely, Federal Republic of Germany Patent Application No. 10 2004 005 342.1, filed on Feb. 2, 2004, having inventor Ludwig Ciüsserath, and DE-OS 10 2004 005 342.1 and DE-PS 10 2004 005 342.1, are hereby incorporated by reference as if set forth in their entirety herein for the purpose of correcting and explaining any possible misinterpretations of the English translation thereof. In addition, the published equivalents of the above corresponding foreign and international patent publication applications, and other equivalents or corresponding applications, if any, in corresponding cases in the Federal Republic of Germany and elsewhere, and the references and documents cited in any of the documents cited herein, such as the patents, patent applications and publications, are hereby incorporated by reference as if set forth in their entirety herein.

Some examples of stepping motors that may possibly be utilized or possibly adapted for use in at least one possible embodiment of the present application may possibly be found in the following U.S. Pat. No. 6,348,774 issued to Andersen et al. on Feb. 19, 2002; U.S. Pat. No. 6,373,209 issued to Gerber et al. on Apr. 16, 2002; U.S. Pat. No. 6,424,061 issued to Fukuda et al. on Jul. 23, 2002; U.S. Pat. No. 6,509,663 issued to Aoun on Jan. 21, 2003; U.S. Pat. No. 6,548,923 to Ohnishi et al. on Apr. 15, 2003; and U.S. Pat. No. 6,661,193 issued to Tsai on Dec. 9, 2003.

All of the references and documents, cited in any of the documents cited herein, are hereby incorporated by reference as if set forth in their entirety herein. All of the documents cited herein, referred to in the immediately preceding sentence, include all of the patents, patent applications and publications cited anywhere in the present application.

Some examples of bottle closing machines which may possibly be utilized or adapted for use in at least one possible embodiment may possibly be found in the following U.S. Pat. No. 4,389,833, entitled "Bottle closing machine having bottle neck washing arrangement;" U.S. Pat. No. 4,205,502, entitled "Rotary bottle closing machine;" U.S. Pat. No. 6,484,477, entitled "Capping machine for capping and closing containers, and a method for closing containers;" U.S. Pat. No. 6,430,896, entitled "Capping machine;" U.S. Pat. No. 5,918,442, entitled "In-line capping machine;" U.S. Pat. No. 5,400,564, entitled "Capping machine;" and U.S. Pat. No. 5,669,209, entitled "In-line capping machine."

The description of the embodiment or embodiments is believed, at the time of the filing of this patent application, to adequately describe the embodiment or embodiments of this patent application. However, portions of the description of the embodiment or embodiments may not be completely applicable to the claims as originally filed in this patent application, as amended during prosecution of this patent application, and as ultimately allowed in any patent issuing from this patent application. Therefore, any statements made relating to the embodiment or embodiments are not intended to limit the claims in any manner and should not be interpreted as limiting the claims in any manner.

The details in the patents, patent applications and publications may be considered to be incorporable, at applicant's option, into the claims during prosecution as further limitations in the claims to patentably distinguish any amended claims from any applied prior art.

The purpose of the title of this patent application is generally to enable the Patent and Trademark Office and the public to determine quickly, from a cursory inspection, the nature of this patent application. The title is believed, at the time of the filing of this patent application, to adequately reflect the general nature of this patent application. However, the title may not be completely applicable to the technical field, the object or objects, the summary, the description of the embodiment or embodiments, and the claims as originally filed in this patent application, as amended during prosecution of this patent application, and as ultimately allowed in any patent issuing from this patent application. Therefore, the title is not intended to limit the claims in any manner and should not be interpreted as limiting the claims in any manner.

The abstract of the disclosure is submitted herewith as required by 37 C.F.R. §1.72(b). As stated in 37 C.F.R. §1.72 (b):

> A brief abstract of the technical disclosure in the specification must commence on a separate sheet, preferably following the claims, under the heading "Abstract of the Disclosure." The purpose of the abstract is to enable the Patent and Trademark Office and the public generally to determine quickly from a cursory inspection the nature and gist of the technical disclosure. The abstract shall not be used for interpreting the scope of the claims.

Therefore, any statements made relating to the abstract are not intended to limit the claims in any manner and should not be interpreted as limiting the claims in any manner.

The embodiments of the invention described herein above in the context of the preferred embodiments are not to be taken as limiting the embodiments of the invention to all of the provided details thereof, since modifications and variations thereof may be made without departing from the spirit and scope of the embodiments of the invention.

At Least Partial List of Nomenclature

1, 1*a*, 1*b* Plant
2 Bottles
3 Housing
4 False floor
5 Plenum
5.1 Door
6 Vertical partition
7 Auxiliary room
8 Partition
8.1 Window
9 Personnel entry airlock
10 Sterile room
10.1 Clean room
10.2 Security room
10.2.1, 10.2.2 Segment of the security room
10.2.3, 10.2.4 Segment of the security room
11 Partition
12 Rinser
12.1 Shield
12.2 Top cover
13 Filling machine
13.1 Shield
13.2 Top cover
14 Capping machine
14.1 Shield
15 Floor
16 Air passage openings
17 Foot element
18, 19 Intermediate wall
20-23 Air filtering device
21.1, 22.1, 23.1 Air distribution duct
24 Vertical air duct
25 Opening
26 Air conditioning device
27 Room
A Direction of transport of the empty bottles 2 being fed
B Direction of transport of the filled and closed bottles 2

What is claimed is:

1. An aseptic container filling plant comprising:

a clean room comprising wall structures, a ceiling, and a floor;

said wall structures being sealed airtight or essentially airtight with respect to the outside environment;

at least one container handling machine disposed within said clean room and comprising one of: a container filling machine, a container closing machine, and a container cleaning machine;

at least one substantially cylindrical shield disposed to surround at least an upper portion of said at least one container handling machine about a vertical axis thereof;

at least one filtering device to filter air and introduce the filtered air into said clean room to create a downward flow of filtered air, outside of said at least one shield, from said ceiling and toward said floor of said clean room;

said at least one shield comprising a lower portion disposed adjacent but a distance from said floor to permit entry of the filtered air into said at least one shield;

said at least one shield comprising an upper portion disposed to extend through at least one opening in said ceiling to form at least one air outlet above said at least one container handling machine; and said at least one shield being configured to guide an upward flow of air therethrough past said at least one container handling machine and out through said air outlet.

2. The aseptic container filling plant according to claim 1, wherein:

said at least one container handling machine comprises first, second, and third container handling machines;

said first container handling machine comprises a container cleaning machine, said second container handling machine comprises a container filling machine, and said third container handling machine comprises a container closing machine; and said at least one shield comprises first, second, and third shields, each of which is disposed about a corresponding one of said container handling machines.

3. The aseptic container filling plant according to claim 2, wherein one of (A) and (B):

(A) said clean room is divided by at least one partition or wall into at least two separate sub-rooms that separately contain said filling machine and said closing machine; and (B) said clean room is divided by at least two partitions or intermediate walls into at least three separate sub-rooms that separately contain said filling machine, said closing machine, and said cleaning machine.

4. The aseptic container filling plant according to claim 3, wherein said partitions or intermediate walls comprise openings configured to permit the passage of at least one of: air and containers between sub-rooms.

5. The aseptic container filling plant according to claim 4, wherein said at least one filtering device comprises a plurality of filtering devices, one for each of said sub-rooms.

6. The aseptic container filling plant according to claim 5, wherein said plant comprises a security room separated from said clean room by at least one wall of said clean room, which security room is also supplied with filtered air by at least one of said filtering devices.

7. The aseptic container filling plant according to claim 6, wherein:

said security room comprises an air outlet opening;

said security room extends only along a portion of the periphery of said clean room; and at least a portion of the walls of said clean room comprise glass or a glass-like material or plastic.

8. The aseptic container filling plant according to claim 7, wherein:

each of said filling machine, said closing machine, and said cleaning machine comprises a rotor configured to hold a plurality of containers, and configured to rotate about a vertical machine axis;

each of said shields surrounds the vertical machine axis of its corresponding one of said filling machine, said closing machine, and said cleaning machine; and each of said shields is in the shape of a hollow cylinder.

9. The aseptic container filling plant according to claim 8, wherein said plant comprises:

an airlock room;

an intermediate room disposed to connect said airlock room to said security room and to permit passage of personnel therethrough from said airlock room to said security room;

at least one additional filtering device and at least one additional air outlet for at least one of: said airlock room and said intermediate room; and said at least one additional air outlet is disposed adjacent a floor of at least one of said airlock room and said intermediate room.

10. The aseptic container filling plant according to claim 9, wherein:

said container filling plant comprises an upper room disposed above the ceiling of said clean room;

the ceiling comprises a false floor of said upper room;

said filtering devices and said air outlets are disposed on or in said false floor; and said air outlets exhaust air into said upper room.

11. The aseptic container filling plant according to claim 10, wherein:

said at least one additional filtering device for said airlock room and/or said intermediate room is in communication via its air inlet with an auxiliary room to exhaust air into said auxiliary room;

said container filling plant comprises an air conditioning and filtering device to supply said upper room and/or said auxiliary room with dehumidified and air conditioned air;

each of said filtering devices comprises at least one motor-driven fan and a heat exchanger through which air can flow to cool or heat the air;

said shields are made at least partly of a transparent material; and said plant is configured to fill and close beverage bottles.

12. The aseptic container filling plant according to claim 1, wherein said at least one container handling machine comprises a rotor configured to hold a plurality of containers, and configured to rotate about a vertical machine axis.

13. The aseptic container filling plant according to claim 12, wherein:

said at least one shield surrounds the vertical machine axis of said at least one container handling machine; and said at least one shield is substantially in the shape of a hollow cylinder.

14. The aseptic container filling plant according to claim 13, wherein:

said plant comprises a container cleaning machine disposed within said clean room and upstream of said container filling machine; and said container cleaning machine is at least partially surrounded by an additional shield that is disposed within said clean room and forms an exhaust air duct to permit an upward flow of air therethrough to said at least one air outlet.

15. The aseptic container filling plant according to claim 14, wherein:

said cleaning machine comprises a rotor configured to hold a plurality of containers, and configured to rotate about a vertical machine axis;

said additional shield surrounds the vertical machine axis of said cleaning machine; and said additional shield is substantially in the shape of a hollow cylinder.

16. The aseptic container filling plant according to claim 15, wherein said plant is configured to fill and close beverage bottles.

17. The aseptic container filling plant according to claim 1, wherein:

said at least one container handling machine comprises a plurality of container handling machines; and said clean room is divided by at least one partition or wall into at least two separate sub-rooms, each of which contains one of said container handling machines.

18. The aseptic container filling plant according to claim 1, wherein:

said plant comprises a security room separated from said clean room by at least one wall of said clean room, which security room is also supplied with filtered air by at least one of said filtering devices;

said security room comprises an air outlet opening; and said security room extends only along a portion of the periphery of said clean room.

19. The aseptic container filling plant according to claim 1, wherein said plant comprises:

an airlock room;

an intermediate room disposed to connect said airlock room to a security room and to permit passage of personnel therethrough from said airlock room to said security room;

at least one additional filtering device and at least one additional air outlet for at least one of: said airlock room and said intermediate room; and said at least one additional air outlet is disposed adjacent a floor of at least one of said airlock room and said intermediate room.

20. The aseptic container filling plant according to claim 1, wherein:

said at least one container handling machine comprises a rotor and a plurality of container handling devices disposed on and about a peripheral portion of said rotor; and said peripheral portion of said rotor is disposed to project beyond said shield such that said container handling devices are disposed outside of said shield.

* * * * *